US010132561B2

(12) United States Patent
Roberts et al.

(10) Patent No.: US 10,132,561 B2
(45) Date of Patent: Nov. 20, 2018

(54) REFRIGERANT COMPOSITION CONTROL

(75) Inventors: Mark Julian Roberts, Kempton, PA (US); Adam Adrian Brostow, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 1828 days.

(21) Appl. No.: 12/540,903

(22) Filed: Aug. 13, 2009

(65) Prior Publication Data

US 2011/0036121 A1 Feb. 17, 2011

(51) Int. Cl.
*F25J 1/00* (2006.01)
*F25J 1/02* (2006.01)

(52) U.S. Cl.
CPC ..... *F25J 1/0022* (2013.01); *F25J 1/005* (2013.01); *F25J 1/0072* (2013.01); *F25J 1/0204* (2013.01); *F25J 1/025* (2013.01); *F25J 1/0265* (2013.01); *F25J 1/0279* (2013.01); *F25J 2210/06* (2013.01); *F25J 2220/44* (2013.01); *F25J 2220/62* (2013.01); *F25J 2270/16* (2013.01)

(58) Field of Classification Search
CPC ..... F25J 1/025; F25J 1/0072; F25J 1/0022; F25J 2270/16; F25J 1/005; F25J 1/02; F25J 1/0204; F25J 1/004; F25J 1/0279; F25J 1/0265; F25J 3/00
USPC ..... 62/606, 612–614, 623, 650
See application file for complete search history.

(56) References Cited

U.S. PATENT DOCUMENTS

| | | | | |
|---|---|---|---|---|
| 3,478,529 | A | 11/1969 | Boykin et al. | |
| 3,511,058 | A | 5/1970 | Becker | |
| 5,881,569 | A * | 3/1999 | Campbell | F25J 3/0209 62/621 |
| 5,916,260 | A * | 6/1999 | Dubar | 62/613 |
| 6,041,619 | A | 3/2000 | Fischer et al. | |
| 6,438,994 | B1 | 8/2002 | Rashad et al. | |
| 6,978,638 | B2 | 12/2005 | Brostow et al. | |
| 2004/0231359 | A1 * | 11/2004 | Brostow et al. | 62/623 |
| 2008/0115530 | A1 * | 5/2008 | Mock et al. | 62/620 |

FOREIGN PATENT DOCUMENTS

| | | |
|---|---|---|
| DE | 102006039889 A1 | 2/2008 |
| JP | 06-101962 | 4/1994 |
| JP | 11-142054 | 5/1999 |
| JP | 2009-501896 T2 | 1/2009 |
| WO | 2007-011155 A1 | 1/2007 |
| WO | 2009072900 A1 | 6/2009 |

* cited by examiner

*Primary Examiner* — Ned Landrum
*Assistant Examiner* — Webeshet Mengesha
(74) *Attorney, Agent, or Firm* — Amy Carr-Trexler

(57) ABSTRACT

A system and method for removal of a contaminant comprising removing a liquefied portion of a refrigerant stream comprising nitrogen from a reverse Brayton cycle refrigerant system, introducing the liquefied refrigerant stream into a contaminant removal column as a reflux stream removing a contaminant stream from the bottom of the contaminant removal column, removing a vapor stream enriched in nitrogen from the top of the contaminant removal column, and introducing the vapor stream enriched in nitrogen back into the reverse Brayton cycle refrigerant system.

9 Claims, 7 Drawing Sheets

REFRIGERANT COMPOSITION CONTROL

BACKGROUND

Natural gas may be liquefied by employing so-called reverse-Brayton cycles (sometimes called gas recycle or nitrogen recycle), where isentropically expanding gaseous refrigerant is used to provide the refrigeration. A natural gas feed is typically at a higher pressure than a nitrogen refrigerant stream used to cool it. It is conceivable, therefore, that natural gas may leak into a nitrogen refrigerant circuit within a liquefier heat exchanger. For example, in a plate-and-fin heat exchanger, a parting sheet may leak allowing a natural gas stream to enter the refrigerant cycle. In a wound-coil heat exchanger, for example, a tube may leak allowing a natural gas stream to enter the refrigerant cycle in the shell portion of the exchanger. In either case, hydrocarbons, and methane in particular, may build up in the refrigerant circuit lowering the cycle's efficiency. The cycle efficiency will be lowered because the system pressure must be lowered to keep the refrigerant near dew point at the cold expander discharge. The system pressure must be lowered to avoid excess liquid at the discharge of the expander that may cause damage to the equipment. Even small leaks can build up over time. One of the advantages of using pure nitrogen, for example, as a refrigerant is that it is inert, therefore, a hydrocarbon leak into the inert refrigerant stream would then make it flammable.

One method for dealing with a hydrocarbon leak in a refrigerant circuit required lowering the feed gas pressure, which in turn, lowered or even reversed the leak in the refrigeration circuit. Lowering the feed gas pressure, however, lowered the cycle's efficiency. If the liquefaction and subcooling took place in separate heat exchangers, for example, and the leak occurred in the subcooler, then the leak could also be mitigated by lowering the pressure of the liquefied natural gas (LNG) entering the subcooler to slightly below the nitrogen pressure with no effect on the cycle's efficiency.

Another method used to deal with a relatively small leak was to purge the refrigerant circuit and increase the pure nitrogen makeup. A small makeup is normally required to compensate for compressor seal and other losses. Purging, however, wastes nitrogen, the principal component of the gaseous refrigerant. The purge could also be combined with the fuel, but doing so would increase the fuel's nitrogen content thereby causing more nitrogen oxide to be released into the air. Further, the nitrogen makeup, or the ability to regenerate the nitrogen for the refrigeration cycle, may be limited on a floating application.

Another method disclosed use of natural gas liquefiers, where isentropically expanding gaseous refrigerant was used to provide the refrigeration and a portion of refrigerant was liquefied to reflux a distillation column to remove nitrogen from liquefied natural gas product depending on the feed compositions and liquefied natural gas product specifications. The nitrogen was rejected, however, from the liquefied natural gas product, and not from the gaseous refrigerant.

There is, therefore, a need in the art to address the possible leak problem without purging, without interrupting the production until the next scheduled shutdown when the repairs can be made, and without decreasing the efficiency of the system.

SUMMARY

Embodiments of the present invention satisfy this need in the art by providing a system and method for removal of a contaminant in a refrigeration system without purging, without interrupting the production until the next scheduled shutdown when the repairs can be made, and without decreasing the efficiency of the system. Embodiments of the present invention also provide a system and method for controlling the inventory of the refrigerant.

In one embodiment, a method for removal of a contaminant is disclosed, comprising: removing a liquefied portion of a refrigerant stream comprising nitrogen from a reverse Brayton cycle refrigerant system; introducing at least a portion of said liquefied portion of the refrigerant stream into a contaminant removal column as a reflux stream; removing a contaminant stream from the bottom of the contaminant removal column; removing a vapor stream enriched in nitrogen from the top of the contaminant removal column; and introducing the vapor stream enriched in nitrogen back into the reverse Brayton cycle refrigerant system.

In another embodiment, a system for removal of a contaminant is disclosed, comprising: a reverse Brayton cycle refrigerant system; a contaminant removal column; a first conduit for providing fluid flow communication between the reverse Brayton cycle refrigerant system and the top of the contaminant removal column; a second conduit for providing fluid flow communication between the top of the contaminant removal column to the reverse Brayton cycle refrigerant system; and a third conduit for providing fluid flow communication between the bottom of the contaminant removal column and a contaminant storage medium.

In yet another embodiment, a method for removal of a contaminant is disclosed, comprising: removing a portion of a gaseous refrigerant stream comprising nitrogen from a reverse Brayton cycle refrigerant system; liquefying the removed portion of the gaseous refrigerant stream; introducing the liquefied refrigerant stream into a contaminant removal column as a reflux stream; removing a contaminant stream from the bottom of the contaminant removal column; removing a vapor stream enriched in nitrogen from the top of the contaminant removal column; and introducing the vapor stream enriched in nitrogen back into the reverse Brayton cycle refrigerant system.

In yet another embodiment, a method for liquefying a natural gas stream is disclosed, comprising: cooling and liquefying a portion of a nitrogen refrigerant stream from a reverse Brayton cycle refrigerant system by indirect heat exchange against the refrigerant stream; and storing at least a portion of said cooled and liquefied portion of the nitrogen refrigerant stream in a storage vessel.

BRIEF DESCRIPTION OF THE DRAWINGS

The foregoing brief summary, as well as the following detailed description of exemplary embodiments, is better understood when read in conjunction with the appended drawings. For the purpose of illustrating embodiments of the invention, there is shown in the drawings exemplary constructions of the invention; however, the invention is not limited to the specific methods and instrumentalities disclosed. In the drawings.

DETAILED DESCRIPTION

A natural gas liquefaction system and method that uses gaseous refrigerant comprising nitrogen to provide at least a portion of refrigeration duty required to liquefy and/or subcool natural gas is disclosed. Excess hydrocarbons present in gaseous refrigerant may be removed in a hydrocarbon removal column. A portion of gaseous refrigerant may be introduced into the column. Hydrocarbon-depleted overhead product may be removed from the top of the column and returned to the refrigerant circuit. Hydrocarbon-rich bottom product may be removed from the bottom of the column. A portion of gaseous refrigerant may be at least partially liquefied and introduced to the top of the column as reflux. The portion of gaseous refrigerant used as reflux may be at least partially liquefied by indirect heat exchange with another portion of gaseous refrigerant. The gaseous refrigerant may be performing, therefore, an auxiliary function in that it cools and/or liquefies the gaseous refrigerant for use as reflux and/or storage. The portion of gaseous refrigerant used as reflux may be at least partially liquefied by isentropic expansion into the two-phase region.

The hydrocarbon-rich bottom product may be combined with an LNG product. The boilup for the column may be provided by introducing a portion of gaseous natural gas to the bottom of the column. The boilup for the column may be provided by condensing portion of gaseous natural gas in a reboiler that vaporizes a portion of the liquid at the bottom of the column. The boilup for the column may be provided by subcooling a portion of liquid natural gas in the reboiler. The boilup for the column may be provided by cooling a portion of gaseous refrigerant in said reboiler. The boilup for the column may be provided by external utility such as water.

Figure 1A:
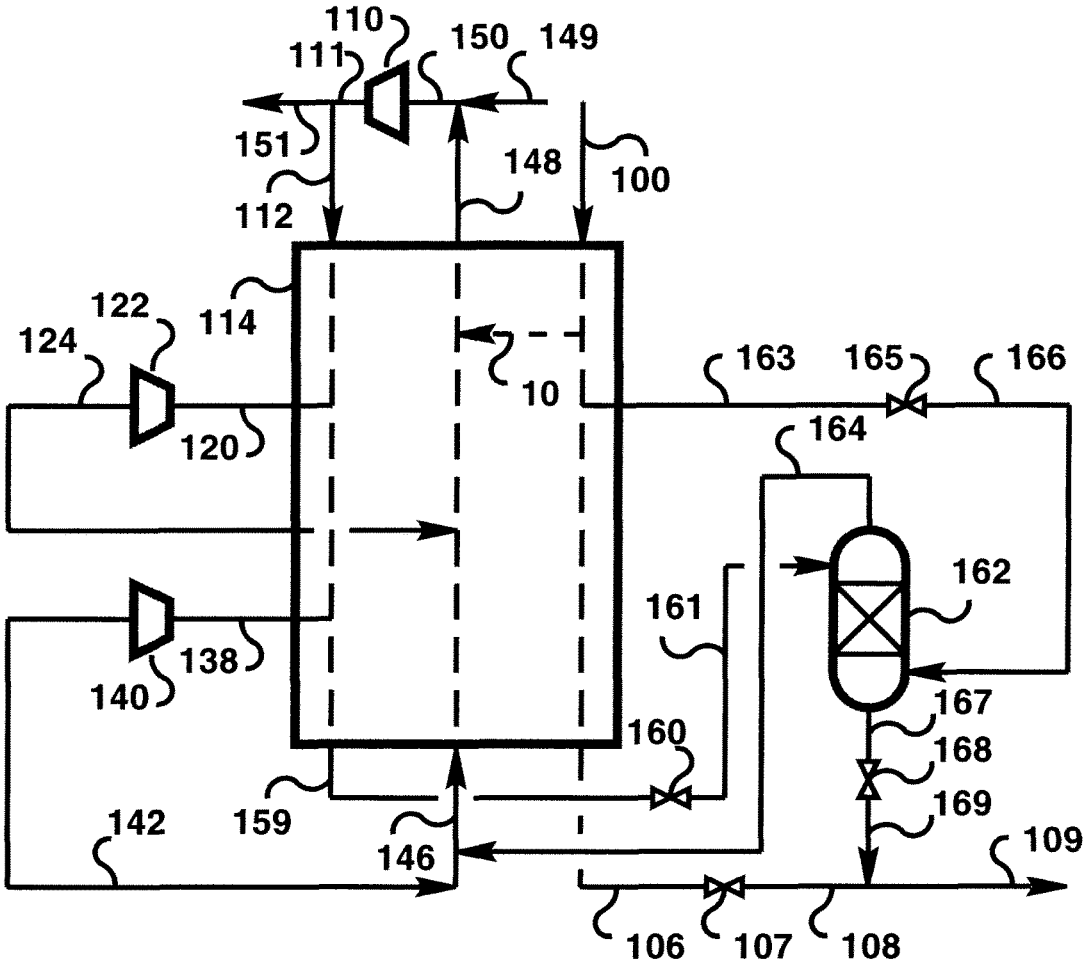
FIG. 1A is a flow chart illustrating an exemplary system and method involving aspects of the present invention.

As illustrated in FIG. 1A, a natural gas feed stream 100 may be cooled, liquefied, and subcooled through indirect heat exchange against a warming gaseous refrigerant stream 146 in a liquefier heat exchanger 114. The refrigerant stream 146 may be a nitrogen stream, for example. The resulting liquefied, subcooled natural gas stream 106 may be reduced in pressure across valve 107 to produce subcooled LNG product stream 108. The recovered subcooled LNG product stream 108 may then be stored, shipped, or used for another process, for example.

Gaseous low-pressure refrigerant stream 150, which comprises the resultant stream 148 after the warming gaseous refrigerant stream 146 exits the liquefier heat exchanger 114, may be compressed in refrigerant compressor 110 resulting in high-pressure refrigerant stream 111. At least a portion 112 of high-pressure refrigerant stream 111 may be then introduced and cooled in liquefier heat exchanger 114. A portion 120 of the partially cooled stream 112 may be expanded in expander 122 to produce stream 124.

Another portion 138 of stream 112 may be removed from liquefier heat exchanger 114, downstream of the removal of portion 120, and expanded in expander 140 to produce stream 142. Stream 142 may be combined with a stream of hydrocarbon depleted vapor product 164 (i.e., a vapor stream enriched in nitrogen, for example) withdrawn from the top of a contaminant removal column 162 where the combined stream 146 may be introduced into the cold end of the liquefier heat exchanger 114. The contaminant removal column 162 may be a hydrocarbon removal column, for example.

Stream 124 from expander 122 may be combined with partially warmed stream 146 resulting in stream 148. Stream 148 may be combined with an intermittent nitrogen makeup stream 149 to replenish the refrigerant, for example, to produce the combined stream 150. The combined stream 150 may then be introduced into the suction of the refrigerant compressor 110 completing the two-expander reverse-Brayton gas refrigeration cycle loop (i.e., where a gas undergoes compression, followed by substantially constant-pressure cooling, and then the high-pressure gas undergoes substantially isentropic expansion to provide refrigeration).

Stream 151, a portion of stream 111, represents any nitrogen losses leaving the refrigeration loop. In reality, losses can come from multiple sources or from any part of the refrigeration circuit. Stream 151 may also represent a nitrogen purge stream. For simplicity, the nitrogen makeup stream 149 and the nitrogen loss or purge stream 151 are not shown in subsequent FIGS. 2-5, however, their associated roles may or may not be also applied to those subsequent figures.

FIG. 1A illustrates how the refrigerant feed within liquefier heat exchanger 114 may develop a leak, shown as contaminant stream 10 entering refrigerant circuit stream 146. The contaminant stream 10 may be a hydrocarbon rich stream, for example.

A portion of refrigerant stream 112 may be liquefied in liquefier heat exchanger 114 to yield stream 159. Stream 159 may be reduced in pressure across valve 160 resulting in liquid stream 161. Liquid stream 161 may then be introduced into the top of the contaminant removal column 162 as reflux. The contaminant removal column 162 may remove methane, for example, that accumulates in the gaseous refrigerant due to a leak 10. The contaminant removal column 162 may also purify the nitrogen refrigerant when the initial charge contains hydrocarbons. For example, if the source of nitrogen refrigerant is a nitrogen removal unit (NRU) or a nitrogen stripper column that removes nitrogen from a feed, the contaminant removal column 162 will purify the gaseous nitrogen for use as a refrigerant.

In this exemplary embodiment, the contaminant removal column 162 may be the only additional piece of major equipment required to deal with the contaminant stream 10. The exemplary embodiments provide a relatively small (in size) and low-cost solution to the occurrence of a potential leak of a contaminant stream 10.

All of the exemplary embodiments may be utilized on Floating Production Storage and Offloading (FPSO) vessels, for example. The exemplary embodiments require very little space and may allow for production and/or storage of small amounts of liquid nitrogen, for example, to be used as makeup or replacement refrigerant to counter any losses.

A portion 163 of partially cooled natural gas feed stream 100 may be withdrawn from liquefier heat exchanger 114, reduced in pressure across valve 165 resulting in stream 166, and then introduced into the bottom of contaminant removal column 162 to provide vapor traffic for the contaminant removal column 162. Stream 166 may be a partial vapor stream, for example. Stream 163 can also be withdrawn upstream of liquefier heat exchanger 114 as a portion of natural gas feed stream 100. A hydrocarbon-rich liquid product stream 167 from contaminant removal column 162 may be reduced in pressure across valve 168 to produce stream 169. Stream 169 may be combined with the liquefied subcooled natural gas stream 108 stream to yield combined LNG product stream 109.

Compressor inter-coolers and after-coolers are not shown for simplicity, but may be utilized in conjunction with, for example, refrigerant compressor 110.

Figure 1B:
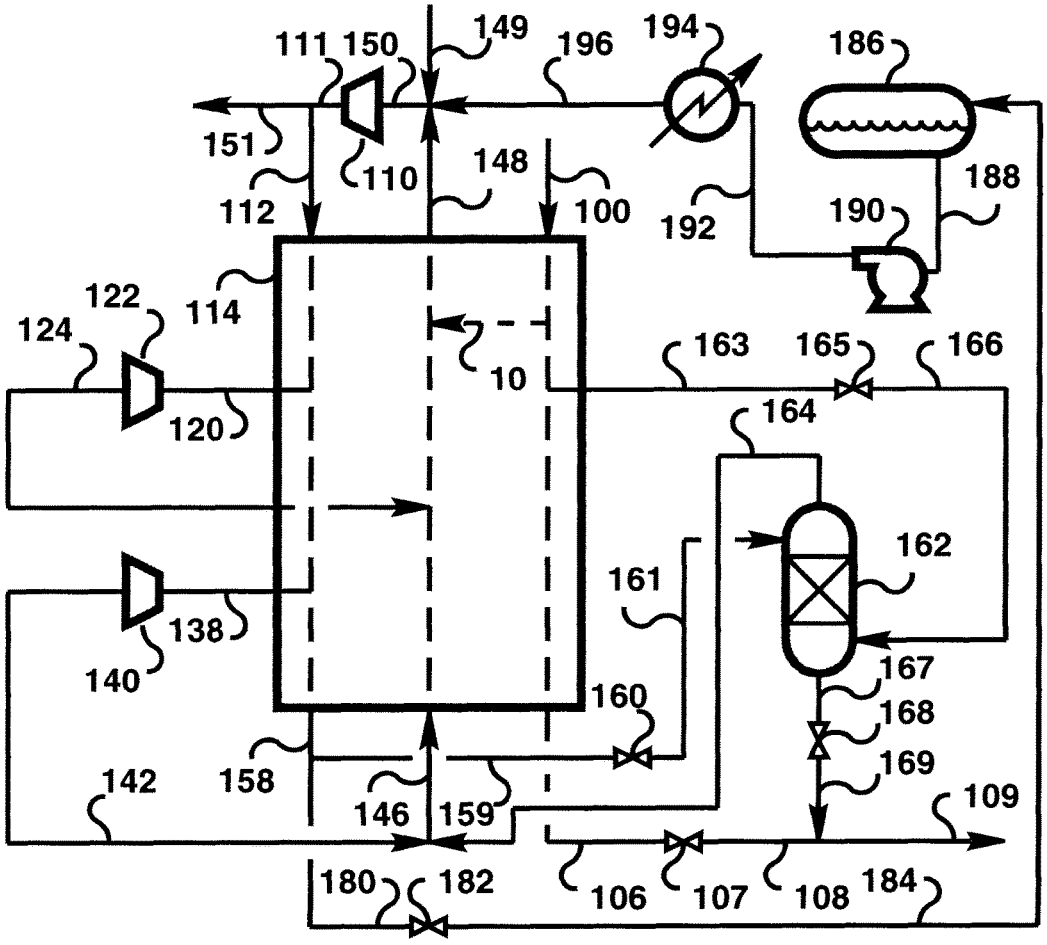
FIG. 1B is a flow chart illustrating an exemplary system and method involving aspects of the present invention.

FIG. 1B illustrates an exemplary configuration similar to FIG. 1A, however, in this exemplary embodiment, a portion 180 of stream 158 exiting the liquefier heat exchanger 114 may be reduced in pressure across valve 182 to yield stream 184. Stream 184 may then enter a liquid nitrogen (LIN) storage tank 186. During normal operations, stream 180 may not be present or may be just a small portion of the circulating refrigerant stream 158. Stream 180 may be increased before turndown, for example, to store refrigerant for later use, including turn-up or restart.

Stream 159, which is now a portion of stream 158 exiting the liquefier heat exchanger 114, may be reduced in pressure across valve 160 resulting in liquid stream 161. Liquid stream 161 may be introduced into the top of the contaminant removal column 162 as reflux.

During turn-up or restart, the LIN stream 188 may be withdrawn from LIN storage tank 186, pumped to the appropriate pressure in pump 190, and resulting stream 192 may be then vaporized in vaporizer 194 to yield stream 196. Stream 196 may then be introduced into the suction end of refrigerant compressor 110.

As illustrated in FIG. 1B, stream 158, and more broadly the refrigeration circuit, may serve a dual purpose of providing a supply stream to be used as reflux in the contaminant removal column 162 for composition control purposes and providing a supply stream of LIN to a LIN storage tank 186 to be used for refrigerant inventory control purposes.

Figure 1C:
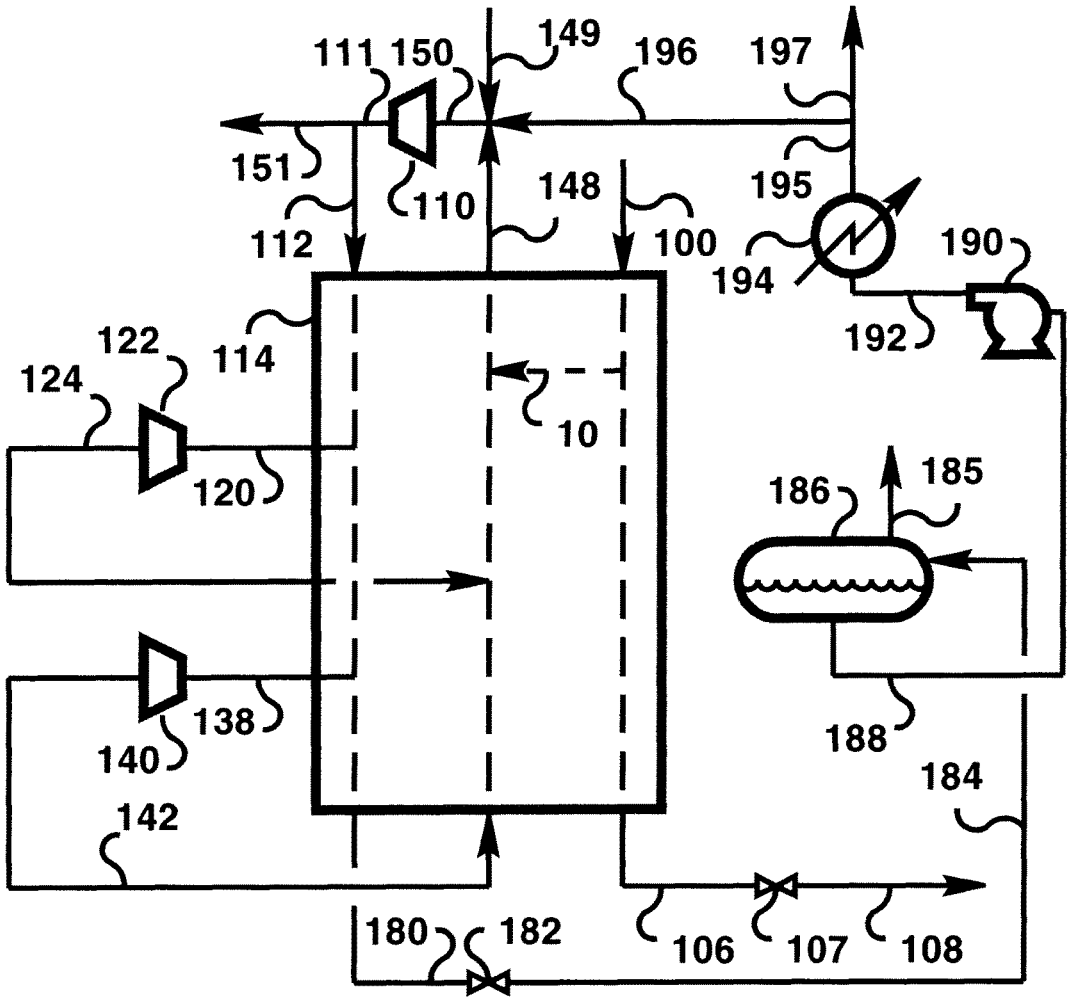
FIG. 1C is a flow chart illustrating an exemplary system and method involving aspects of the present invention.

Even without the contaminant removal column 162, the liquid nitrogen circuit (i.e. the portion of the refrigerant circuit where the refrigerant is liquefied in liquefier heat exchanger 114) may be present for nitrogen inventory (turn-up, turndown) control. Liquid stream 161 may be stored in a liquid nitrogen (LIN) tank, for example. As illustrated in FIG. 1C, stream 180, a liquefied portion of stream 112 exiting the liquefier heat exchanger 114, may be reduced in pressure across valve 182 to yield stream 184. Stream 184 may then enter a LIN storage tank 186.

LIN stream 188 may be withdrawn from LIN storage tank 186, pumped to the appropriate pressure in pump 190, and resulting stream 192 may be then vaporized in vaporizer 194 to yield stream 195. A portion 197 of stream 195 may be used for various purposes, including, but not limited to, a purge gas. Therefore, in this embodiment, a portion of the stored nitrogen may be used for a purpose other than the refrigeration loop.

The remaining stream 196 of stream 195 may combined with streams 149, 148 to yield stream 150 to be then introduced into the suction end of refrigerant compressor 110. Stream 185 exiting the LIN storage tank 186 represents a small stream of flash gas that may or may not be present if the LIN is stored in the LIN storage tank 186 under high-enough pressure.

In another embodiment, the liquid nitrogen refrigerant from the LIN storage tank 186 may be loaded and transported for delivery to another location.

Figure 2:
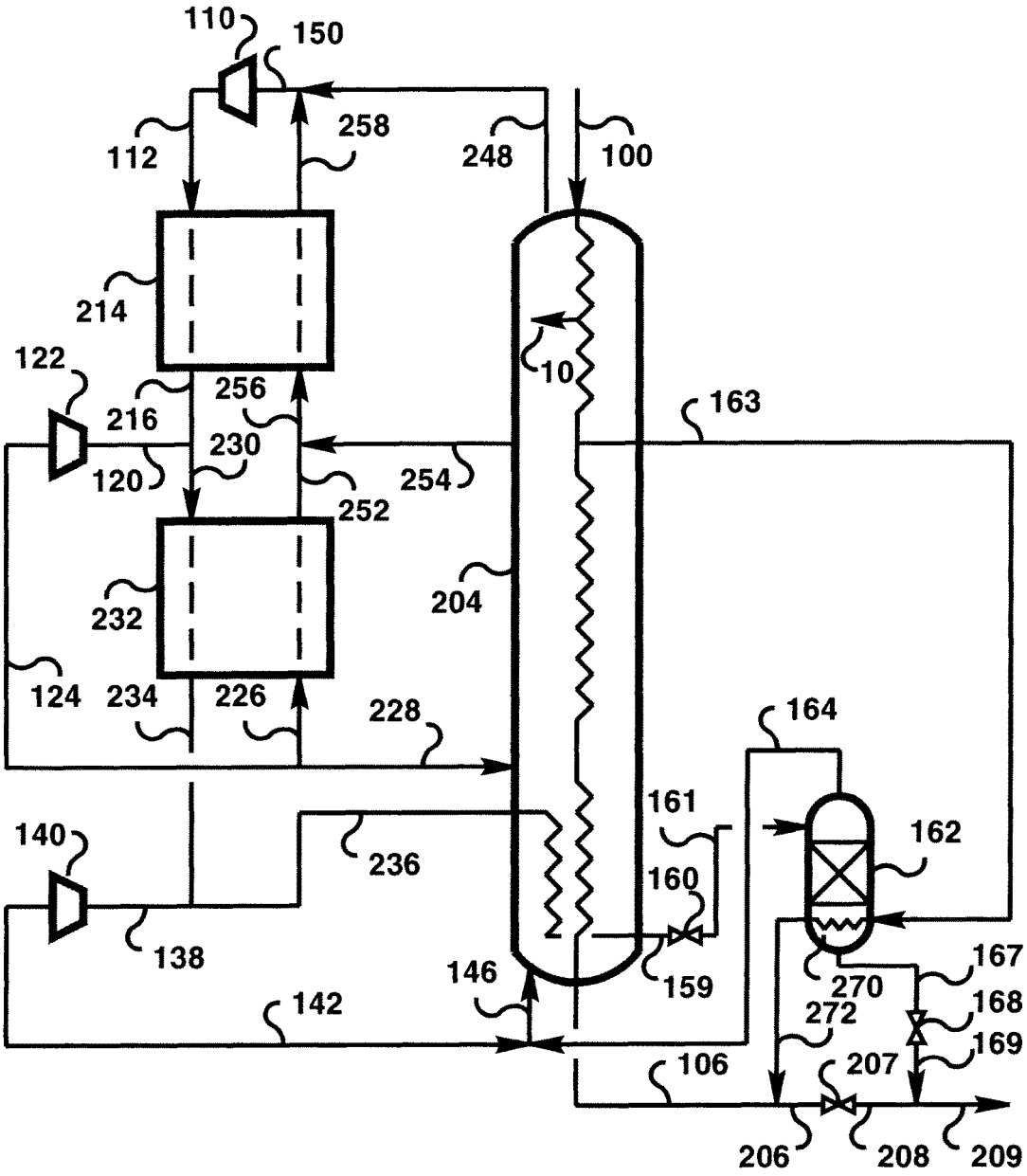
FIG. 2 is a flow chart illustrating an exemplary system and method involving aspects of the present invention.

FIG. 2 illustrates an exemplary embodiment similar to FIG. 1A, however, the liquefier heat exchanger 114 of FIG. 1A is split into three exchangers 214, 232, 204, where heat exchangers 214, 232 cool only the gaseous refrigerant while the main wound-coil liquefier heat exchanger 204 cools the natural gas feed 100. Contaminant removal column 162 may also include a reboiler 270 that allows better purity control and prevents possible further contamination of the refrigerant loop.

As illustrated in FIG. 2, a natural gas feed stream 100 may be cooled, liquefied, and subcooled against a warming gaseous refrigerant stream 146 (typically nitrogen) in a main wound-coil liquefier heat exchanger 204 to produce liquefied, subcooled, natural gas stream 106.

Gaseous low-pressure refrigerant stream 150 may be compressed in refrigerant compressor 110 where the resultant high-pressure refrigerant stream 112 may be cooled in heat exchanger 214 resulting in stream 216. Resulting stream 216 may be split into streams 120 and 230. Stream 120 may be expanded in expander 122 to produce stream 124 while stream 230 may be further cooled in heat exchanger 232 resulting in stream 234.

Resulting stream 234 may be split into streams 236 and 138. Stream 138 may be expanded in expander 140 to produce stream 142. Stream 142 may be combined with stream 164 from the contaminant removal column 162 and the combined stream 146 may be introduced into the cold end of the main wound-coil liquefier heat exchanger 204. Stream 236, a small portion of stream 234, may be liquefied in main wound-coil liquefier heat exchanger 204 to yield stream 159.

Stream 124 may be split into streams 226 and 228. Stream 226 may be introduced into heat exchanger 232 while stream 228 may be introduced into main wound-coil liquefier heat exchanger 204. Stream 228 combines with warmed-up stream 146 in main wound-coil liquefier heat exchanger 204. A portion of warmed combined streams 146 and 228 may be withdrawn from main wound-coil liquefier heat exchanger 204 as stream 254 to balance the precooling (warm) section of the main wound-coil liquefier heat exchanger 204 that requires less refrigeration.

Stream 226 may be warmed in heat exchanger 232 resulting in stream 252. Stream 252 may be combined with stream 254 from main wound-coil liquefier heat exchanger 204 resulting in combined stream 256. Stream 256 may be further warmed in heat exchanger 214 producing stream 258. Gaseous refrigerant stream 248 leaves the warm end of main wound-coil liquefier heat exchanger 204. Stream 258 may be combined with stream 248 from main wound-coil liquefier heat exchanger 204 to form combined stream 150. Stream 150 may be then introduced into the suction of the refrigerant compressor 110 completing the reverse-Brayton gas refrigeration cycle loop.

In this embodiment, the leak, shown as contaminant stream 10, enters the shell side of the main wound-coil liquefier heat exchanger 204. The contaminant stream 10 may be a hydrocarbon rich stream, for example.

In this exemplary embodiment, stream 166 may be liquefied in the reboiler heat exchanger 270 to provide boilup for the contaminant removal column 162. Resulting liquid 272 may be then combined with stream 106 yielding combined stream 206. Stream 206 may be reduced in pressure across valve 207 yielding the LNG product stream 208.

A hydrocarbon-rich liquid product 167 may be removed from contaminant removal column 162 where it may be reduced in pressure across valve 168 resulting in stream 169. Stream 169 may be combined with LNG product stream 208 to yield the final LNG product stream 209.

Stream 163 can also be withdrawn upstream of the main wound-coil liquefier heat exchanger 204 as a portion of natural gas feed stream 100. Withdrawing stream 163 from the natural gas feed stream 100 would be thermodynamically less efficient, however, because the reboiler size would have to be smaller. In another embodiment, another external heating utility such as water may be used.

Resulting stream 159 from the main wound-coil liquefier heat exchanger 204 may be reduced in pressure across valve 160 yielding stream 161. Stream 161 may be introduced to the top of the contaminant removal column 162 as reflux. Liquid stream 161 may also be stored in a LIN tank, for example.

Figure 3:
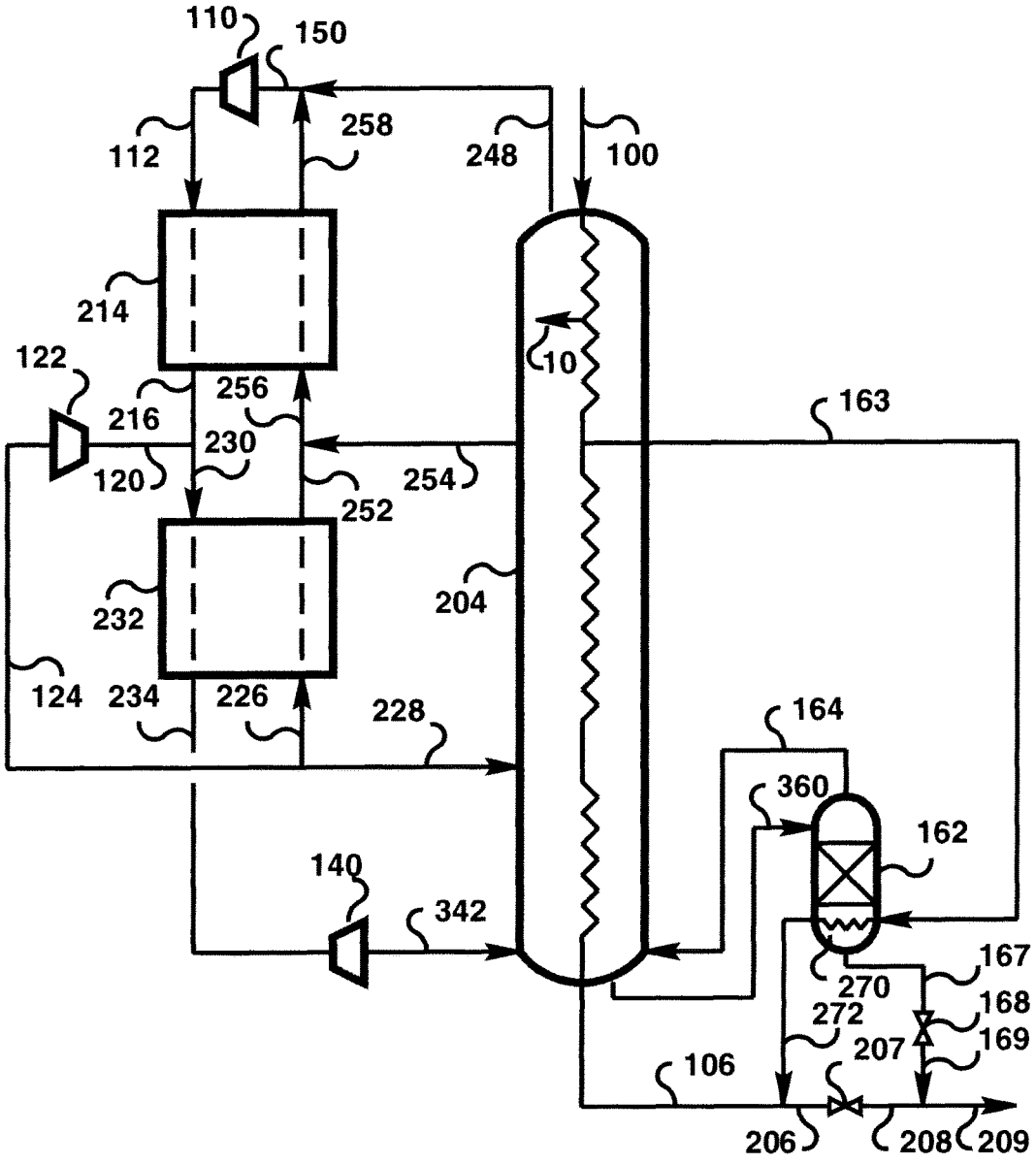
FIG. 3 is a flow chart illustrating an exemplary system and method involving aspects of the present invention.

FIG. 3 illustrates an exemplary embodiment comprising a system without the gaseous refrigerant liquefaction circuit (i.e., where a small portion of the refrigerant is liquefied by indirect heat exchange against a warming expanded gaseous refrigerant). Stream 342 exiting expander 140 is two-phase stream. The bottom of the heat exchanger 204, preferably a wound coil type with gaseous refrigerant on the shell side, acts as a phase separator. The liquid portion 360 of the two-phase stream 342 leaves heat exchanger 204 to be used as reflux in contaminant removal column 162. Liquid stream 360 may be stored in a LIN tank, for example.

As illustrated in FIG. 3, a natural gas feed stream 100 may be cooled, liquefied, and subcooled against a warming gaseous refrigerant streams 342 and 164 (typically nitrogen) in main wound-coil liquefier heat exchanger 204 to produce liquefied, subcooled, natural gas stream 106. In this embodiment, streams 342 and 164 are combined in the main wound-coil liquefier heat exchanger 204.

Gaseous low-pressure refrigerant stream 150 may be compressed in refrigerant compressor 110 where the resultant high-pressure refrigerant stream 112 may be cooled in heat exchanger 214 resulting in stream 216. Resulting stream 216 may be split into streams 120 and 230. Stream 120 may be expanded in expander 122 to produce stream 124 while stream 230 may be further cooled in heat exchanger 232 resulting in stream 234. Stream 234 may be then expanded in expander 140 yielding stream 342 as a two-phase stream.

Stream 124 may be split into streams 226 and 228. Stream 226 may be introduced into the warm end of heat exchanger 232 while stream 228 may be introduced into main wound-coil liquefier heat exchanger 204. Stream 228 combines with warmed-up streams 342 and 164 in main wound-coil liquefier heat exchanger 204. A portion of warmed combined streams 342, 164, 228 may be withdrawn from main wound-coil liquefier heat exchanger 204 as stream 254 to balance the precooling (warm) section of the main wound-coil liquefier heat exchanger 204 that requires less refrigeration.

Stream 226 may be warmed in heat exchanger 232 resulting in stream 252. Stream 252 may be combined with stream 254 from main wound-coil liquefier heat exchanger 204 resulting in combined stream 256. Stream 256 may be further warmed in heat exchanger 214 producing stream 258. Gaseous refrigerant stream 248 leaves the warm end of main wound-coil liquefier heat exchanger 204. Stream 258 may be combined with stream 248 from main wound-coil liquefier heat exchanger 204 to form combined stream 150. Stream 150 may be then introduced into the suction of the refrigerant compressor 110 completing the reverse-Brayton gas refrigeration cycle loop.

In this embodiment, the leak, shown as contaminant stream 10, enters the shell side of the main wound-coil liquefier heat exchanger 204. The contaminant stream 10 may be a hydrocarbon rich stream, for example.

In this embodiment, stream 163 may be liquefied in the reboiler heat exchanger 270 to provide boilup for the contaminant removal column 162. Resulting liquid 272 may be then combined with stream 106 yielding combined stream 206. Stream 206 may be reduced in pressure across valve 207 yielding the LNG product stream 208.

A hydrocarbon-rich liquid product 167 may be removed from contaminant removal column 162 where it may be reduced in pressure across valve 168 resulting in stream 169. Stream 169 may be combined with LNG product stream 208 to yield the final LNG product stream 209.

Stream 163 can also be withdrawn upstream of the main wound-coil liquefier heat exchanger 204 as a portion of natural gas feed stream 100. Withdrawing stream 163 from the natural gas feed stream 100 would be thermodynamically less efficient, however, because the reboiler size would have to be smaller. In another embodiment, another external heating utility such as water may be used.

Figure 4:
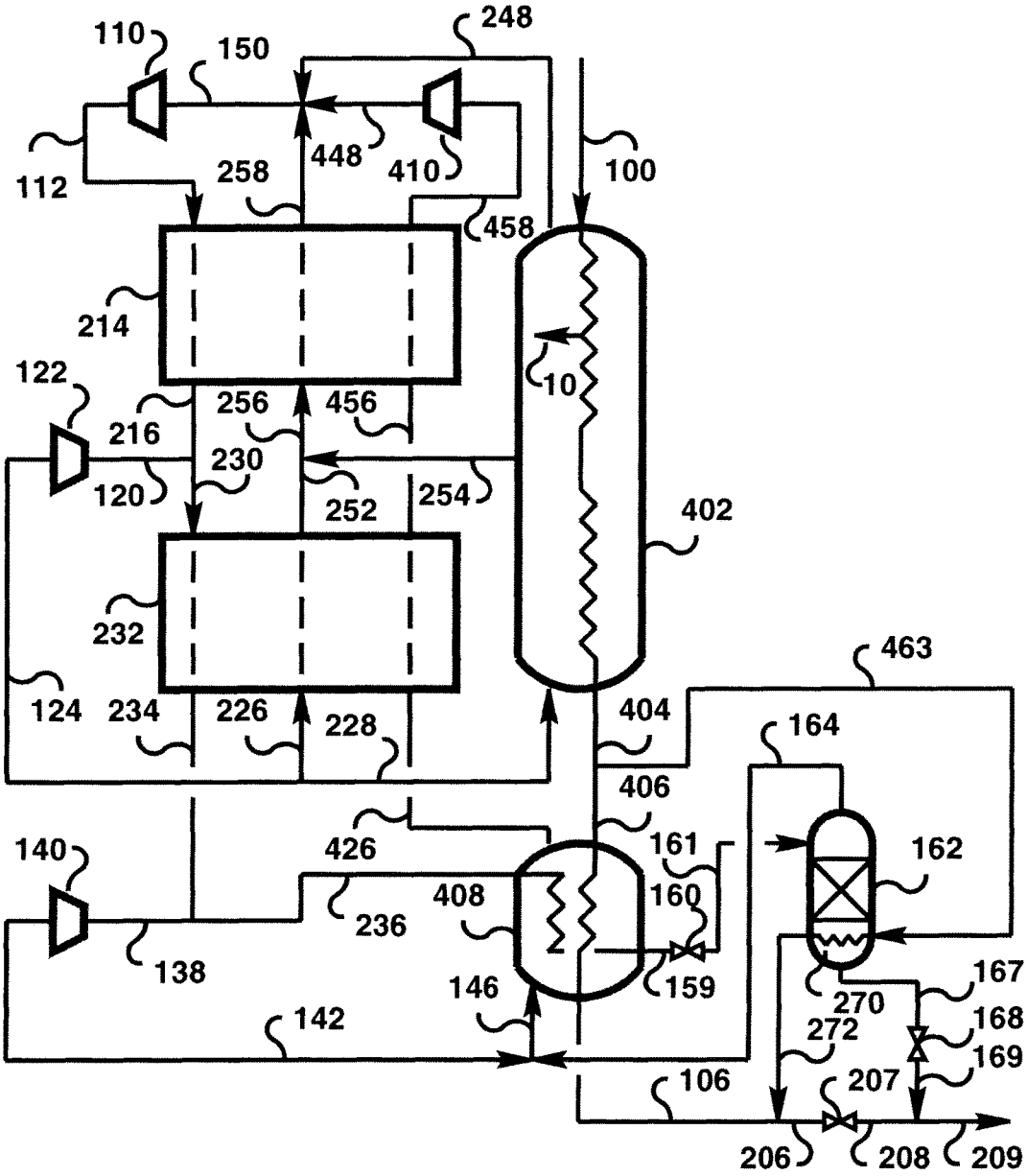
FIG. 4 is a flow chart illustrating an exemplary system and method involving aspects of the present invention.

FIG. 4 illustrates an exemplary system where the gaseous refrigerant may be expanded to two different pressures and the main liquefier heat exchanger may be split into the liquefying heat exchanger section 402 and subcooling heat exchanger section 408.

As illustrated in FIG. 4, a natural gas feed stream 100 may be cooled and liquefied against a warming gaseous refrigerant stream 228 (typically nitrogen) in liquefying heat exchanger section 402 to yield stream 404. Stream 404 may be split into streams 406 and 463. Stream 406 may be further subcooled in subcooling heat exchanger 408 producing subcooled natural gas stream 106. Stream 463 may be liquefied in the reboiler heat exchanger 270 to provide boilup for the contaminant removal column 162.

Stream 463 can also be withdrawn upstream of the liquefying heat exchanger section 402 as a portion of natural gas feed stream 100. Withdrawing stream 463 from the natural gas feed stream 100 would be thermodynamically less efficient, however, because the reboiler size would have to be smaller. In another embodiment, another external heating utility such as water may be used.

Gaseous low-pressure refrigerant stream 150 may be compressed in refrigerant compressor 110 where the resultant high-pressure refrigerant stream 112 may be cooled in heat exchanger 214 resulting in stream 216. Resulting stream 216 may be split into streams 120 and 230. Stream 120 may be expanded in expander 122 to produce stream 124 while stream 230 may be further cooled in heat exchanger 232 resulting in stream 234.

Resulting stream 234 may be then split into streams 138 and 236. Stream 138 may be expanded in expander 140 yielding stream 142. In this embodiment, expander 140 discharges to a lower pressure than expander 122. Stream 236, a small portion of stream 234, may be subcooled in subcooling heat exchanger 408 yielding subcooled stream 159. Subcooled stream 159 may be reduced in pressure across valve 160 resulting in stream 161. Stream 161 may be then introduced into the contaminant removal column 162 as reflux. Liquid stream 161 may also be stored in a LIN tank, for example.

Stream 142 may be combined with stream 164 from the contaminant removal column 162 and the combined stream 146 may be introduced into the cold end of the subcooling heat exchanger 408. Resulting warmed stream 426 may be then further warmed in heat exchanger 232 yielding stream 456. Stream 456 may be then further warmed in heat exchanger 214 yielding stream 458. Stream 458 may be then compressed in refrigerant compressor 410 yielding stream 448.

Stream 124 may be split into streams 226 and 228. Stream 226 may be introduced into the warm end of heat exchanger 232 while stream 228 may be introduced into liquefying heat exchanger section 402. A portion of warmed stream 228 may be withdrawn from liquefying heat exchanger section 402 as stream 254 to balance the precooling (warm) section of the main wound-coil liquefier heat exchanger 402 that requires less refrigeration.

Stream 226 may be warmed in heat exchanger 232 resulting in stream 252. Stream 252 may be combined with stream 254 from liquefying heat exchanger 402 resulting in combined stream 256. Stream 256 may be warmed in heat exchanger 214 yielding stream 258. Gaseous refrigerant stream 248 leaves the warm end of liquefying heat exchanger section 402. Stream 258 may be combined with stream 248 from the liquefying heat exchanger section 402 and stream 448 from the refrigerant compressor 410 to yield stream 150. Stream 150 may be then introduced into the suction of the refrigerant compressor 110 completing the reverse-Brayton gas refrigeration cycle loop.

In this embodiment, the leak, shown as contaminant stream 10, enters the shell side of liquefying heat exchanger section 402. The contaminant stream 10 may be a hydrocarbon rich stream, for example.

Stream 463 may be liquefied in the reboiler heat exchanger 270 to provide boilup for the contaminant removal column 162 resulting in liquid stream 272. Stream 272 may be then combined with stream 206 yielding combined stream 206. Stream 206 may be reduced in pressure across valve 207 yielding the LNG product stream 208.

A hydrocarbon-rich liquid product 167 may be removed from contaminant removal column 162 where it may be reduced in pressure across valve 168 resulting in stream 169. Stream 169 may be combined with LNG product stream 208 to yield the final LNG product stream 209.

Stream 463 may also be withdrawn upstream of the liquefying heat exchanger section 402 as a portion of natural gas feed stream 100. Withdrawing stream 463 from the natural gas feed stream 100 would be thermodynamically less efficient, however, because the reboiler size would have to be smaller. In another embodiment, an external heating utility such as water may be used.

Figure 5:
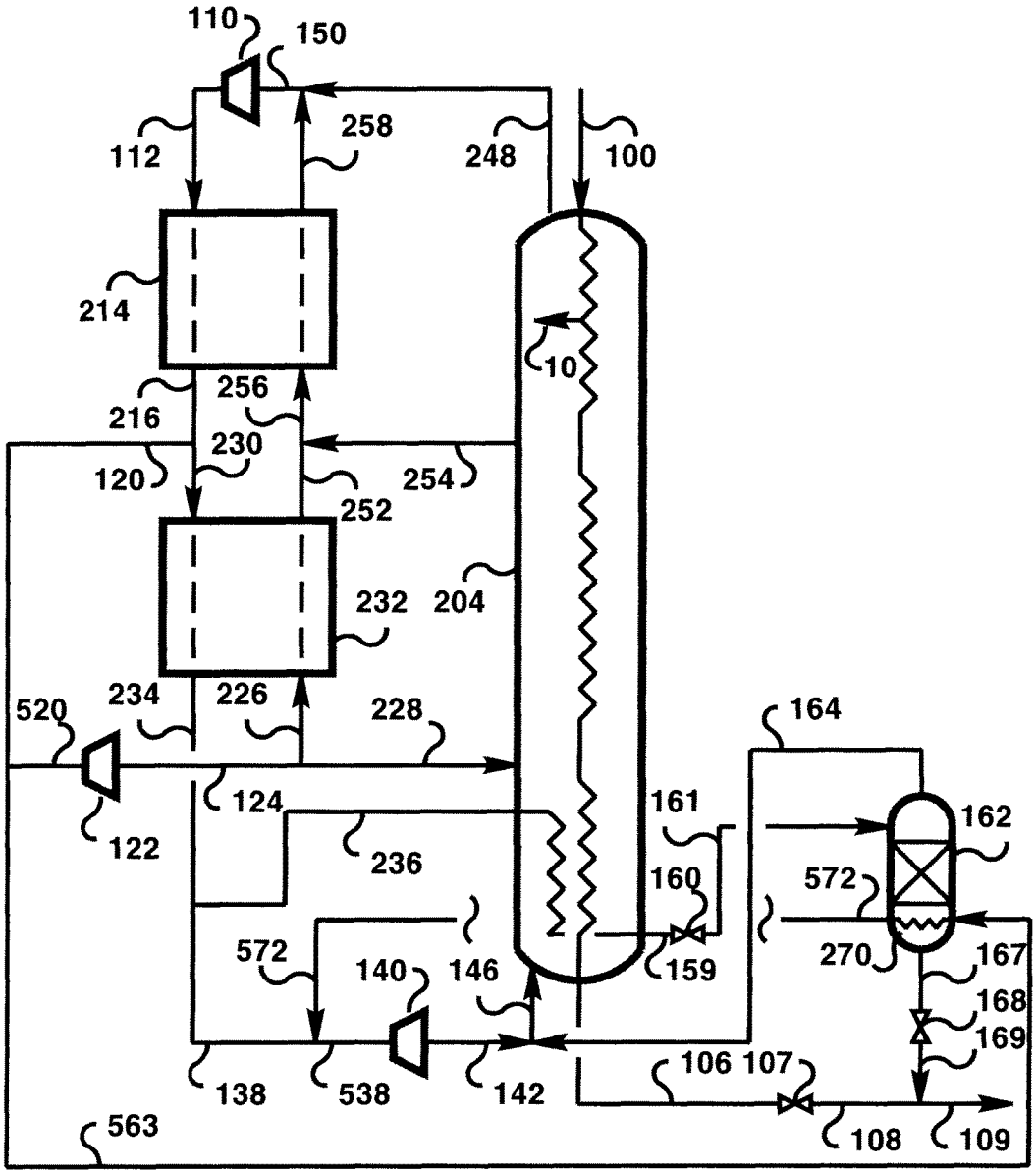
FIG. 5 is a flow chart illustrating an exemplary system and method involving aspects of the present invention.

FIG. 5 illustrates another exemplary system and process. In this embodiment, the contaminant removal column reboiler 270 uses a portion of gaseous refrigerant as heating utility.

As illustrated in FIG. 5, a natural gas feed stream 100 may be cooled, liquefied, and subcooled against a warming gaseous refrigerant stream 146 (typically nitrogen) in a main wound-coil liquefier heat exchanger 204 to produce liquefied, subcooled, natural gas stream 106.

Gaseous low-pressure refrigerant stream 150 may be compressed in refrigerant compressor 110 where the resultant high-pressure refrigerant stream 112 may be cooled in heat exchanger 214 resulting in stream 216. Resulting stream 216 may be split into streams 120 and 230. Stream 230 may be further cooled in heat exchanger 232 resulting in stream 234. Stream 234 may be split into streams 236 and 138. Stream 236, a small portion of stream 234, may be liquefied in main wound-coil liquefier heat exchanger 204 to yield stream 159.

Stream 120 may be split into streams 563 and 520. Stream 563 may be liquefied in the reboiler heat exchanger 270 to provide boilup for the contaminant removal column 162. The resultant stream 572 may be combined with stream 138 to produce stream 538. Stream 538 may be expanded in expander 140 yielding stream 142. Stream 142 may be combined with stream 164 from the contaminant removal column 162 and the combined stream 146 may be introduced into the cold end of the main wound-coil liquefier heat exchanger 204.

Stream 520 may be expanded in expander 122 resulting in stream 124. Stream 124 may be split into streams 226 and 228. Stream 226 may be introduced into heat exchanger 232 while stream 228 may be introduced into main wound-coil liquefier heat exchanger 204. Stream 228 combines with warmed-up stream 146 in main wound-coil liquefier heat exchanger 204. A portion of warmed combined streams 146 and 228 may be withdrawn from main wound-coil liquefier heat exchanger 204 as stream 254 to balance the precooling (warm) section of the main wound-coil liquefier heat exchanger 204 that requires less refrigeration.

Stream 226 may be warmed in heat exchanger 232 resulting in stream 252. Stream 252 may be combined with stream 254 from main wound-coil liquefier heat exchanger 204 resulting in combined stream 256. Stream 256 may be further warmed in heat exchanger 214 producing stream 258. Gaseous refrigerant stream 248 leaves the warm end of main wound-coil liquefier heat exchanger 204. Stream 258 may be combined with stream 248 from main wound-coil liquefier heat exchanger 204 to form combined stream 150. Stream 150 may be then introduced into the suction of the refrigerant compressor 110 completing the reverse-Brayton gas refrigeration cycle loop.

In this embodiment, the leak, shown as contaminant stream 10, enters the shell side of main wound-coil liquefier heat exchanger 204. The contaminant stream 10 may be a hydrocarbon rich stream, for example.

Stream 563 can also be withdrawn upstream of the main wound-coil liquefier heat exchanger 204 as a portion of natural gas feed stream 100. Withdrawing stream 563 from the natural gas feed stream 100 would be thermodynamically less efficient, however, because the reboiler size would have to be smaller. In another embodiment, another external heating utility such as water may be used.

Stream 159 from the main wound-coil liquefier heat exchanger 204 may be reduced in pressure across valve 160 yielding stream 161. Stream 161 may be introduced to the top of the contaminant removal column 162 as reflux. Liquid stream 161 may also be stored in a LIN tank, for example.

A hydrocarbon-rich liquid product 167 may be removed from contaminant removal column 162 where it may be reduced in pressure across valve 168 resulting in stream 169. Stream 106 from the main wound-coil liquefier heat exchanger 204 may be reduced in pressure across valve 107 yielding the LNG product stream 108. Stream 169 may be combined with LNG product stream 108 to yield the final LNG product stream 109.

EXAMPLE

A plant produces 1.5 million tons per annum of LNG. The plant uses a 2-expander reverse-Brayton cycle. The plant uses gaseous nitrogen as refrigerant. The natural gas leak rate into the refrigerant circuit is 90 kg/hr. The natural gas contains 4% $N_2$, 91% methane, and 5% ethane.

A hydrocarbon removal column with a reboiler was added to the liquefier as illustrated in FIG. 2. The hydrocarbon removal column includes five (5) theoretical stages plus the reboiler. The packed bed height of about four (4) feet was used for all cases. The reboiler duty is about 290 KW. Table 1 shows the relative power consumption of the plant as compared to a base case (no leak, pure nitrogen refrigerant) and approximate hydrocarbon removal column diameter using Sulzer 500Y packing as a function of methane concentration maintained in the refrigerant circuit.

TABLE 1

| Methane Maintained in Nitrogen Refrigerant Stream (%) | Power Required (% BC) | Diameter of Contaminant Removal Column (ft) |
|---|---|---|
| 2.5 | 101.8 | 2.8 |
| 5.0 | 101.0 | 2.0 |
| 8.0 | 100.5 | 1.4 |

As illustrated in Table 1, methane can be effectively removed from the refrigerant stream to maintain a low concentration in the refrigerant circuit using a small contaminant removal column with minimal impact on efficiency.

While aspects of the present invention has been described in connection with the preferred embodiments of the various figures, it is to be understood that other similar embodiments may be used or modifications and additions may be made to the described embodiment for performing the same function of the present invention without deviating therefrom. Therefore, the claimed invention should not be limited to any single embodiment, but rather should be construed in breadth and scope in accordance with the appended claims.

The invention claimed is:

1. A method for removal of a hydrocarbon contaminant from a refrigerant stream predominantly comprising nitrogen, comprising:

removing a liquefied portion of the refrigerant stream comprising nitrogen from a reverse Brayton cycle refrigerant system;

introducing at least a portion of said liquefied portion of the refrigerant stream predominantly comprising nitrogen into the top of a contaminant removal column as a reflux stream;

removing a hydrocarbon contaminant stream from the bottom of the contaminant removal column, wherein the hydrocarbon contaminant stream is a hydrocarbon rich stream;

combining the hydrocarbon rich stream with a liquefied subcooled natural gas stream to be used as a liquid natural gas product, wherein the liquefied subcooled natural gas stream is formed by indirect heat exchange of a natural gas feed stream against the refrigerant stream in a liquefier heat exchanger;

removing a vapor stream enriched in nitrogen from the top of the contaminant removal column; and introducing the vapor stream enriched in nitrogen back into the reverse Brayton cycle refrigerant system, wherein the vapor stream enriched in nitrogen is purified in the contaminant removal column for further use as a refrigerant.

2. The method of claim 1, wherein prior to removing said liquefied portion of the refrigerant stream comprising nitrogen from the reverse Brayton cycle refrigerant system, said liquefied portion of the refrigerant stream is cooled and liquefied by indirect heat exchange.

3. The method of claim 1, wherein the method is performed on a Floating Production Storage and Offloading vessel.

4. A method for removal of a hydrocarbon contaminant from a refrigerant stream predominantly comprising nitrogen, comprising:

removing a portion of a gaseous refrigerant stream predominantly comprising nitrogen from a reverse Brayton cycle refrigerant system;

liquefying the removed portion of the gaseous refrigerant stream;

introducing the liquefied refrigerant stream into the top of a contaminant removal column as a reflux stream;

removing a hydrocarbon contaminant stream from the bottom of the contaminant removal column, wherein the hydrocarbon contaminant stream is a hydrocarbon rich stream;

combining the hydrocarbon rich stream with a liquefied subcooled natural gas stream to be used as a liquid natural gas product, wherein the liquefied subcooled natural gas stream is formed by indirect heat exchange of a natural gas feed stream against the refrigerant stream in a liquefier heat exchanger;

removing a vapor stream enriched in nitrogen from the top of the contaminant removal column; and introducing the vapor stream enriched in nitrogen back into the reverse Brayton cycle refrigerant system, wherein the vapor stream enriched in nitrogen is purified in the contaminant removal column for further use as a refrigerant.

5. The method of claim 4, wherein the method is performed on a Floating Production Storage and Offloading vessel.

6. The method of claim 4, further comprising removing at least a portion of said liquefied portion of the refrigerant stream comprising nitrogen from the reverse Brayton cycle refrigerant system and storing the removed portion.

7. The method of claim 1, further comprising introducing a portion of a natural gas feed stream into the bottom of the contaminant removal column to provide vapor traffic for the contaminate removal column.

8. The method of claim 4, further comprising introducing a portion of a natural gas feed stream into the bottom of the contaminant removal column to provide vapor traffic for the contaminate removal column.

9. The method of claim 1, wherein any portion of the natural gas stream that is introduced into the contaminant removal column is introduced solely into the bottom of the column to provide vapor traffic of the contaminant removal column.

* * * * *